United States Patent [19]

Leever et al.

[11] Patent Number: 4,724,168

[45] Date of Patent: Feb. 9, 1988

[54] MECHANICAL GALVANIZING COATING RESISTANT TO CHIPPING, FLAKING AND, CRACKING

[75] Inventors: Harold Leever, Bethlehem, Conn.; John J. Grunwald, Ramat Gan, Israel; Bryan Whitmore, New Haven, Conn.

[73] Assignee: MacDermid, Incorporated, Waterbury, Conn.

[21] Appl. No.: 887,029

[22] Filed: Jul. 17, 1986

[51] Int. Cl.[4] ..... B05D 3/12
[52] U.S. Cl. ..... 427/242
[58] Field of Search ..... 427/242

[56] References Cited

U.S. PATENT DOCUMENTS

| | | | |
|---|---|---|---|
| 3,400,012 | 9/1968 | Golben | 427/242 |
| 3,460,977 | 8/1969 | Golben | 427/242 |
| 4,389,431 | 6/1983 | Erismann | 427/242 |

*Primary Examiner*—Sam Silverberg
*Attorney, Agent, or Firm*—St. Onge, Steward, Johnston & Reens

[57] ABSTRACT

Chipping, flaking, and cracking of mechanical galvanizing coatings applied on metal substrates is prevented by interposing between successive layers of plating metal, which are used in galvanizing the metal substrate, a layer of cushioning metal. Each interposed layer of cushioning metal imparts malleability to the coating such that chipping, cracking, and flaking is prevented or substantially reduced. The plating metal is preferably zinc, while the cushioning metal is preferably tin, lead, or mixtures thereof.

39 Claims, No Drawings

MECHANICAL GALVANIZING COATING RESISTANT TO CHIPPING, FLAKING AND, CRACKING

BACKGROUND OF THE INVENTION

It has been known to plate metal particles on a metal substrate by applying mechanical force sufficient to cause adhesion between the plating metal particles and the surface of the substrate. The mechanical force necessary to cause such adhesion is achieved by placing the plating metal particles, a solid impaction media (e.g. glass beads), materials which promote such plating, and a metal substrate in a rotating ball mill or a tumbling barrel. In this manner, the rotation of the ball mill or a tumbling barrel imparts kinetic energy to the impaction media which is transferred to the plating metal particles such that these particles are pounded into the surface of the substrate as a coating.

The early work in this field of mechanical plating was disclosed in U.S. Pat. Nos. 2,640,001, 2,640,002, Re 23,861, 2,689,808, and 2,723,204 all to Clayton et al. Typically, these mechanical plating processes were undertaken in the presence of a liquid which contains promoter chemicals such as unsaturated fatty acids, film-forming materials, and surfactants. U.S. Pat. No. 3,460,977 to Golben discloses other promoter chemicals for mechanical plating. U.S. Pat. No. 3,328,197 to Simon teaches utilizing promoter chemicals in the form of a solid cake or bar which contain a combination of mechanical plating promoter chemicals. As the mechanical plating cycle progresses, the bar or cake dissolves at a rate which provides optimal amounts of promoter chemical to the mechanical plating process.

U.S. Pat. No. 3,268,356 to Simon ('356 patent) discloses incrementally adding the promoter chemical and/or the plating metal particles to the plating barrel in successive additions to optimize the density and uniformity of the plating metal coating over the entire substrate surface.

To prevent corrosion of thin mechanical plating coatings, i.e. coating up to 25 microns (1.0 mils), it has been suggested that a "sandwich" coating (e.g. a coating of zinc on tin on zinc) be applied to a substrate, as disclosed in U. Meyer's "Mechanical Plating Die Entwicklung des Verfahrens", *Galvanotechnik,* Vol 73, No. 9 (1982).

U.S. Pat. No. 3,531,315 to Golben ("'315 patent") discloses performing a mechanical plating process in the presence of a strong acid. Prior to the '315 patent, agitation of plating metal, impaction media, and substrate generally was conducted in the presence of weak organic acids such as citric acid. This required that the contents of the plating barrel be rinsed free of any strong acids used to clean or copper the parts before starting the citric acid-based plating process. With the process of the '315 patent, it was possible to conduct the mechanical plating process without need for intermediate rising steps, rendering the process extremely economical.

Gradually, it became desirable to use thicker (e.g. from about 1.0 to 5.3 mils compared to mechanical plating coatings which are 0. 1 to 1.0 mils thick) and heavier (e.g. from about 0.7 to 2.5 ounces per square foot) mechanically-applied metallic coatings. Such methods of applying thicker, heavier coatings came to be known as mechanical galvanizing processes. During the development of such mechanical galvanizing processes, it was found that enhanced adhesion of mechanical galvanizing coatings could be achieved by building up thin layers of mechanically plated metal. As taught by the '356 patent, such layered coatings were achieved by the incremental addition of plating metal powder to the process. As a result, the commonly utilized citric acid-based chemistry, such as that described by the '356 patent, could be employed in mechanical galvanizing. The pH of about 3.0 to 3.5 with this chemistry is less aggressive upon the metal powder, and the promoter chemicals can be introduced in bar form (see e.g. U.S. Pat. No. 3,328,197) which slowly disintegrates during the process and gradually releases the chemicals as galvanizing progresses. However, the organic acids and their salts are expensive and tend to complex heavy metal ions which hampers effective effluent treatment.

It was also desired to optimize mechanical galvanizing in accordance with the teachings of the '315 patent to secure the same advantages achieved by mechanically plating in a strong acid (i.e. eliminating the need for intermediate rinsing). However, the chemistry utilized with the process of the '315 patent is not amenable to incremental additions of metal powder, because the 0.5 to 1.5 operating pH in this system is too aggressive on the metal powder. In addition, the typically-used promoter chemicals were introduced in powder form at the start of the galvanizing process with no intervening additions. Utilizing this promoter chemistry in conjunction with the incremental addition of plating metal powder would result in an improper chemical environment at later stages of the process, causing the uncontrolled deposit of metal coatings. Consequently, the conditions necessary to apply successive layers of well consolidated, adherent particles could not be uniformly maintained.

U.S. Pat. No. 4,389,431 to Erismann ("'431 patent) adapted the process of the '315 patent to the incremental metal powder additions of mechanical galvanizing. This was achieved with two chemical promoter systems. The first is a flash promoter which coats the substrate with a thin adherent flash coating of a metal more noble than the plating metal prior to adding the plating metal to the system. The second continuing promoter is then incrementally added with some or all of the incremental additions of a finely divided mechanical plating metal, the layers of which are built up to effect mechanical galvanizing.

Despite this improvement, there continue to be problems with mechanical galvanizing coatings which are not encountered with mechanical plating coatings. One such problem encountered with the thicker mechanical galvanizing coatings is chipping, flaking, and cracking which becomes more of a problem as the thickness of the coating increases. This is a particularly big problem with larger parts which impact against each other and against the galvanizing barrel. On smaller parts, such as nails, the whole coating can flake or chip off when bent in accordance with ASTM Test ASTM B571, Standard Methods of Testing for "Adhesion of Metallic Coatings".

THE INVENTION

It has been discovered that chipping, flaking, and cracking which is unique to mechanical galvanizing coatings can be avoided by incorporating a layer of cushioning metal which is different than the plating metal between thin layers of mechanically-plated metal used in making thick mechanical galvanizing coatings. In the preferred embodiment of the present invention, the layer of cushioning metal is more malleable than the layers of plating metal, while the layers of plating metal are more ductile than the layers of cushioning metal. As taught by D.S. clark and W. R. Varney *Physical Metallurgy For Engineers* (1952), ductility and malleability are descriptive terms related to the ability of the material to be plastically deformed without fracturing in tension or compression, respectively. An example of a plating metal/cushioning metal system which has these qualities is one that utilizes zinc as the plating metal and either tin, lead, or mixtures thereof as the cushioning metal.

The process of mechanically galvanizing by building up thin layers of mechanically plated metal can easily be adapted to incorporate a layer of cushioning metal between layers of plating metal. As taught by the '315 patent and the '431 patent, a substrate to be galvanized is placed in a rotatable plating barrel containing a glass bead impaction media. Water and a strong acid surface conditioner such as sulfuric acid are also added to the barrel and then dispersed by rotation of the plating barrel. As shown in the examples of the '431 patent, for instance, the process according to the '315 patent can optionally include precleaning and rinsing prior to the addition of water and strong acid surface conditioner. Such precleaning can be effected in the plating barrel or in some other tank by either degreasing with an alkaline cleaner, descaling with an acid cleaner, or both degreasing and descaling. After precleaning, the substrate is rinsed. In accordance with the '315 patent, there is no subsequent draining or rinsing after addition of surface conditioner. Although some oxide scale forms on the substrate between rinsing and the addition of water and strong acid surface conditioner, the sulfuric acid surface conditioner will remove such scale during its dispersion in the rotating plating barrel.

After dispersion of the sulfuric acid surface conditioner and water in the rotating plating barrel containing the substrate and impaction media and without either draining the acid from the plating barrel or rinsing the substrate with water, a coppering agent (e.g. copper sulfate pentahydrate) is added to the plating barrel. This causes copper to be deposited on the surfaces of the substrate which then acts as a base for adhesion of subsequent coatings to the substrate.

A promoter chemical is then added to the plating barrel to provide a proper environment for mechanical plating. In addition, the promoter chemical may also help clean the subsequently-added plating metal powder and control the size of plating metal agglomerates. Suitable promoter chemicals contain a strong acid or acid engendering salt and a salt of a metal which is more noble than the subsequently-added plating metal. Optionally, the promoter can also include a dispersant for the subsequently-added plating metal and/or a corrosion inhibitor. The soluble salts of a metal more noble than the plating metal include cadmium, lead, and preferably tin (e.g. stannous chloride, stannous sulfate). The strong acid or acid engendering salt can be, for example, sulfuric acid, potassium or ammonium bisulfate, sulfamic acid, or sodium bisulfate. The dispersant and the corrosion inhibitor can be any of those disclosed in columns 3–4 of the '315 patent. The promoter contains per 100 square feet of plating surface up to 400 grams of the strong acid or acid engendering salt and from about 10 to about 80 grams of the soluble salt of a metal which is more noble than the plating metal. In addition, effective amounts of dispersant and/or corrosion inhibitor can be added as needed for their intended purposes.

After the promoter is charged to the rotating barrel, plating metal powder is added. The addition of the plating metal displaces the metal of the promoter from the liquid in the plating barrel onto the substrate as a flash coating. The rotation of the barrel then causes the glass bead impaction media to strike the substrate such that the plating metal powder is pounded into adherence with the substrate.

Alternatively, the promoter system disclosed by the '431 patent may be used. As noted supra, this system utilizes two promoters—i.e. a flash promoter and a continuing promoter. The flash promoter contains the same ingredients in the same amount as are used with the promoters described above. The continuing promoter includes per pound of plating metal about 20 to about 150 grams of a strong acid or an acid engendering salt, from about 1 to 20 grams of a soluble salt of a metal more noble than the plating metal, and optionally, an effective amount of a dispersant capable of dispersing the plating metal and/or an effective amount of an inhibitor capable of inhibiting corrosion of the substrate and the plating metal. The flash promoter is added to the rotating barrel after coppering is completed and before the addition of plating metal powder. The continuing promoter is added with each incremental addition of plating metal powder added to the rotating barrel. The dual promoter system disclosed in the '431 patent is particularly useful when there is an insufficient amount of inhibitor or dispersant in the barrel prior to completion of mechanical plating. When such deficiencies occur, as can be determined by one of ordinary skill in the art, the continuing promoter can be added. Such additions of continuing promoter may or may not be needed for each addition of particulate plating metal depending on the degree of corrosion and dispersibility in the plating barrel.

Following one or more incremental additions of plating metal powder and optionally continuing promoter, a cushioning metal powder can be added to the plating barrel. As a result of the impaction media striking the substrate during rotation of the barrel, the cushioning metal powder is pounded into adherence with the substrate. Such adherence causes the formation of a cushioning metal layer. Further layers of plating metal with intersticial layers of cushioning metal can be added subsequently.

The cushioning metal is different from the plating metal. In a preferred embodiment of the present invention, the cushioning metal is more malleable and less ductile than the plating metal. These properties are particularly good, because they give the coating a greater resistance to chipping, cracking, and flaking when the substrate strikes similar substrates, the plating barrel wall, or other objects. In a most preferred embodiment, the plating metal is zinc, while the cushioning metal is either tin, lead, or mixtures thereof.

The boundaries between layers of plating metal and cushioning metal are not distinct. Instead, each cushioning layer is diffused into each adjacent plating layer and vice versa. As a result of this diffusion, the galvanized coating has more bendability and chipping resistance. While not wishing to be bound by theory, it is believed that this diffuse boundary is caused by the continued plating of residual plating metal powder in the plating barrel when cushioning metal powder is added and begins to be plated. The same is true when plating metal powder is added to the barrel and begins to be plated while there is residual cushioning metal in the barrel.

The thickness of the plating metal and cushioning metal layers is varied as a result of the amounts of these materials added to the plating barrel in powdered form. Although a wide range of plating layer thickness to cushioning layer thickness ratios can be used in adjacent layers of these materials, it is desirable that this ratio be between about 2 to 1 and 10 to 1, preferably 5 to 1. The amount of plating metal powder and cushioning metal powder added to the plating barrel should be limited such that the thickness of each plating metal layer is 0.5 to 3.0 mils thick, while the thickness of each cushioning layer is 0.1 to 0.4 mils thick. In addition, the total thickness of the alternating plating and cushioning metal layers (i.e. the total thickness of the plating metal layers in addition to the total thickness of the cushioning layers) which cumulatively galvanize the substrate are together 1.0 to 5.3 mils thick, and preferably 1.5 to 4.5 mils thick. Because the thickness of the plating metal layers and cushioning layers are proportional to the weight of plating metal powder and cushioning metal powder used, the respective weight ratios for these materials to be used is preferably between 2 to 1 and 10 to 1, preferably 5 to 1.

There are several ways to galvanize metal substrates with these thicknesses and weight ratios. Each addition of plating metal to the plating barrel can be followed by an addition of cushioning metal and vice, versa. Alternatively, either the cushioning layer or the plating layer or both can be formed by several successive additions of cushioning metal powder and/or plating metal powder.

Another alternative is to use a mixture of particulate cushioning metal and particulate plating metal in forming the cushioning layer. For example, after a plating layer of zinc is applied, a mixture of zinc and tin are added to the plating barrel and are together mechanically plated on the substrate. The weight ratio of simultaneously-added zinc to tin used to form the cushioning layer is between 2 to 1 and 10 to 1, preferably 5 to 1.

EXAMPLE 1

One kilogram of 6d common nails was cleaned, coppered, and tinned in a 0.25 cubic foot capacity hexagonal plating barrel in accordance with the method set forth in U.S. Pat. Nos. 3,531,315 and 4,389,431. Four portions of zinc powder (8 grams each) were then added to the barrel at 2 minute intervals. Two minutes after the last addition, 10 grams of tin powder was added, and the barrel was rotated for three minutes. Six additions of 8 grams of zinc powder were then added to the plating barrel along with 0.25 g of mechanical galvanizing continuing promoter in additions one, three, and five. The barrel was rotated an additional five minutes after the last zinc addition. The nails were then removed from the barrel, rinsed with water, and subjected to the ASTM Standard Methods of Testing for Adhesion of Metallic Coatings, ASTM Designation: B 571-72 (1974) which showed no significant flaking of the mechanical galvanizing coating.

EXAMPLE 2

Example 1 was repeated using lead powder in place of tin powder. The above-described ASTM test showed improved adhesion of the mechanical galvanizing coating with only minor flaking.

EXAMPLE 3

Example 1 was repeated with the following modifications. After the parts are tinned, 3 additions of zinc powder (8 grams each) are added to the plating barrel at 2 minute intervals. Two minutes after the last addition, 10 grams of tin are added and rotation is continued for 3 minutes. Three additions of zinc (8 grams each) are made along with continuing promoter (0.25 g) in additions 1 and 3 at 2 minute intervals. Tin powder (10 grams) is added and rotation is continued for 3 minutes. Finally, 3 additions of 8 grams each of zinc along with a continuing promoter (0.25 g) in the 2nd addition are made at 2 minute intervals and barrel rotation is continued for 5 minutes after the last zinc addition. The parts are then unloaded and rinsed with water. The ASTM bending test showed no significant flaking of the mechanical galvanizing coating.

EXAMPLE 4

Example 3 is repeated at half-scale in a 0.1 cubic foot barrel using lead powder (5 grams per addition) in place of tin powder. The ASTM bending test showed no significant flaking of the mechanical galvanizing coating.

EXAMPLE 5

As a control test, Example 4 is repeated without addition of lead powder. Ten additions of zinc are made with 0.1 g of continuing promoter in the fifth, seventh, and ninth additions. The ASTM bending test showed significant flaking of the mechanical galvanizing coating.

EXAMPLE 6

550 lbs of cast iron clevises are cleaned, coppered, and tinned in a 20 cubic foot barrel in accordance with U.S. Pat. No. 3,531,315. Three additions of zinc powder (1 lb. each) are made to the plating barrel at 2 minute intervals which provides a coat of mechanically plated zinc on the parts. One pound of tin powder is then added to the barrel and plating is continued for 3 minutes. Nine additions of material are then made to the plating barrel at 1½minute intervals with each addition consiting of 1 lb. zinc powder, 1 ounce of continuing promoter, 5 grams of aluminum powder, and 5 grams of $Na_2SiF_6$. Barrel rotation is continued for three minutes after the final addition. The parts are then unloaded, rinsed, and dried. The finished coating (having an average thickness of 3.6 mils) was very resistant to chipping resulting from part to part impact.

EXAMPLE 7

Example 6 was repeated without the addition of tin powder cushioning metal. The finished parts had a significant amount of chipped coating.

Although the invention has been described in detail for the purpose of illustration, it is understood that such detail is solely for that purpose and variations can be made therein by those skilled in the art without departing from the spirit and scope of the invention.

What is claimed:

1. A process of mechanically galvanizing a metal substrate with a chip resistant coating comprising:

adding a particulate plating metal to a plating liquid containing said metal substrate and an impaction media;

agitating said plating liquid, whereby said impaction media strikes said metal substrate and causes said plating metal to adhere to said metal substrate as a plating layer;

adding to said plating liquid a particulate cushioning metal which is less ductile and more malleable than said plating metal;

agitating said plating liquid whereby said impaction media strikes said metal substrate and causes said cushioning metal to adhere to said metal substrate as a cushioning layer over said plating layer; and repeating said adding and agitating of said particulate plating metal and optionally said particulate cushioning metal until said metal substrate is provided with an outer plating layer under which are alternating cushioning and plating layers with improved resistance to chipping and cumulatively galvanizing said metal substrate.

2. A process of galvanizing a metal substrate with a thick mechanically applied coating of a plating metal, comprising the steps of:

(a) contacting said substrate with an acidic solution to clean and descale the surfaces of said substrate;

(b) rinsing said substrate with water;

(c) adding a surface conditioner containing strong acid to an agitated plating barrel containing impaction medium and said substrate to maintain the surfaces of said substrate clean and oxide-free;

(d) without intermediate rinsing, adding to the agitated plating barrel a coppering agent which forms a thin copper coating on the clean, oxide-free surfaces of said substrate;

(e) without intermediate rinsing, adding to said agitated plating barrel a metal salt more noble than the ultimate plating metal and a small quantity of particulate plating metal to flash coat the coppered surfaces of said substrate with said more noble metal;

(f) without intermediate rinsing, adding to said agitated plating barrel a particulate plating metal, whereby said impaction media causes said plating metal to adhere to the coppered and more noble metal coated surfaces of said metal substrate as a plating layer;

(g) without intermediate rinsing, adding to said agitated plating barrel a particulate cushioning metal which is less ductile and more malleable than said plating metal, whereby said impaction media causes said cushioning metal to adhere to said plating metal substrate as a cushioning layer over said plating layer; and (h) without intermediate rinsing, repeating step (f), and optionally step (g), until said metal substrate is provided with an outer plating metal layer under which are alternating cushioning and plating layers.

3. A process according to claim 1, wherein said cushioning metal is selected from the group consisting of tin, lead, and mixtures thereof, and wherein said plating metal is zinc.

4. A process according to claim 3, wherein the alternating cushioning and plating layers with improved resistance to chipping and cumulatively galvanizing said metal substrate are together 1.5 to 4.5 mils thick.

5. A process according to claim 4, wherein each cushioning layer is diffused into each adjacent plating layer.

6. A process according to claim 3, wherein each cushioning layer is diffused into each adjacent plating layer.

7. A process according to claim 3, wherein said impaction media is a plurality of glass beads.

8. A process according to claim 1, wherein the alternating cushioning and plating layers resistant to chipping and cumulatively galvanizing said metal substrate are together 1.5 to 4.5 mils thick.

9. A process according to claim 1, wherein each cushioning layer is diffused in each adjacent plating layer.

10. A process according to claim 1, wherein said impaction media is a plurality of glass beads.

11. A process according to claim 1, further comprising:

degreasing said metal substrate and coppering said degreased metal substrate prior to any adding of said particulate plating metal or said particulate cushioning metal.

12. A process according to claim 11, further comprising:

descaling said metal substrate prior to said coppering and after said degreasing.

13. A process according to claim 11, further comprising:

rinsing said metal substrate after said degreasing and prior to said coppering and adding a strong acid surface conditioner solution which is ultimately utilized as said plating liquid.

14. A process according to claim 13, further comprising:

descaling said metal substrate after said degreasing and prior to said rinsing.

15. A process according to claim 13, wherein said strong acid surface conditioner is sulfuric acid.

16. A process according to claim 1 further comprising:

adding a promoter to said plating liquid to enhance adhesion of said particulate plating metal.

17. A process according to claim 16, wherein a flash promoter is added to said plating liquid prior to said adding said particulate plating metal, and wherein a continuing promoter is added to said plating liquid with said particulate plating metal.

18. A process according to claim 1, wherein said adding said particulate plating metal powder to said plating liquid is achieved by several consecutive additions of said particulate plating metal.

19. A process according to claim 1, wherein said adding said particulate cushioning metal to said plating liquid is achieved by several consecutive additions of said particulate cushioning metal.

20. A process according to claim 1, wherein said cushioning layer contains a mixture of plating metal and cushioning metal.

21. A process of mechanically galvanizing a metal substrate in an agitated plating liquid which comprises an impaction media, said process comprising the steps of:

adding a particulate plating metal to said agitated plating liquid, whereby said impaction media strikes said metal substrate and causes said particulate plating metal to adhere to said metal substrate as a plating layer;

adding a particulate cushioning metal which is less ductile and more malleable than said plating metal to said agitated plating liquid, whereby said impaction media strikes said metal substrate and causes said particulate cushioning metal to adhere to said metal substrate as a cushioning layer over said plating layer; and repeating said adding of said particulate plating metal and said adding of said particulate cushioning metal until said metal substrate is provided with an outer plating layer under which are alternating plating and cushioning layers resistant to chipping and cumulatively galvanizing said metal substrate.

22. A process according to claim 21, wherein said cushioning layer contains a mixture of plating metal and cushioning metal.

23. A process according to claim 21, wherein said cushioning metal is selected from the group consisting of tin, lead, and mixtures thereof, and wherein said plating metal is zinc.

24. A process according to claim 23, wherein the alternating cushioning and plating layers resistant to chipping and cumulatively galvanizing said metal substrate are together 1.5 to 4.5 mils thick.

25. A process according to claim 24, wherein each cushioning layer is diffused into each adjacent plating layer.

26. A process according to claim 23, wherein each cushioning layer is diffused into each adjacent plating layer.

27. A process according to claim 23, wherein said impaction media is a plurality of glass beads.

28. A process according to claim 21, wherein the alternating cushioning and plating layers resistant to chipping and cumulatively galvanizing said metal substrate are together 1.5 to 4.5 mils thick.

29. A process according to claim 21, wherein each cushioning layer is diffused in each adjacent plating layer.

30. A process according to claim 21, wherein said impaction media is a plurality of glass beads.

31. A process according to claim 21, further comprising:

degreasing said metal substrate and coppering said degreased metal substrate prior to any adding of said particulate plating metal or said particulate cushioning metal.

32. A process according to claim 31, further comprising:

descaling said metal substrate prior to said coppering and after said degreasing.

33. A process according to claim 31, further comprising:

rinsing said metal substrate after said degreasing and prior to said coppering and adding a strong acid surface conditioner solution which is ultimately utilized as said plating liquid.

34. A process according to claim 33, further comprising:

descaling said metal substrate after said degreasing and prior to said rinsing.

35. A process according to claim 33, wherein said strong acid surface conditioner is sulfuric acid.

36. A process according to claim 21 further comprising:

adding a promoter to said plating liquid to enhance adhesion of said particulate plating metal.

37. A process according to claim 36, wherein a flash promoter is added to said plating liquid prior to said adding said particulate plating metal, and wherein a continuing promoter is added to said plating liquid with said particulate plating metal.

38. A process according to claim 21, wherein said adding said particulate plating metal to said plating liquid is achieved by several consecutive additions of said particulate plating metal.

39. A process according to claim 21, wherein said adding said particulate cushioning metal to said plating liquid is achieved by several consecutive additions of said particulate cushioning metal.

* * * * *